United States Patent [19]

Welch

[11] Patent Number: 4,974,750

[45] Date of Patent: Dec. 4, 1990

[54] DETERGENT-ADDITIVE DISPENSER

[75] Inventor: Rodney M. Welch, Newton, Iowa

[73] Assignee: Maytag Corporation, Newton, Iowa

[21] Appl. No.: 419,548

[22] Filed: Oct. 10, 1989

[51] Int. Cl.[5] ..... A47L 15/44

[52] U.S. Cl. ..... 222/129; 222/651; 222/160; 222/504

[58] Field of Search ..... 222/651, 652, 168.5, 222/170, 354, 129, 368, 410, 504, 505, 160; 134/56 D, 57 D, 58 D, 95

[56] References Cited

U.S. PATENT DOCUMENTS

| | | | |
|---|---|---|---|
| 3,102,664 | 9/1963 | Lines | 222/651 |
| 3,233,782 | 2/1966 | Ullman, Jr. et al. | 222/651 |
| 3,285,471 | 11/1966 | Geiger et al. | 222/651 |
| 3,411,671 | 11/1968 | Harvey et al. | 222/652 |
| 3,426,944 | 2/1969 | French | 222/129 |
| 3,565,291 | 2/1971 | Granddeweut | 222/651 |
| 3,827,600 | 8/1974 | Janke | 222/651 |
| 3,828,975 | 8/1974 | Robandt, II et al. | 222/651 |
| 4,009,801 | 3/1977 | Williams | 222/651 |
| 4,149,654 | 4/1979 | Nelson et al. | 222/651 |
| 4,355,738 | 10/1982 | Herbst et al. | 222/129 |
| 4,623,753 | 11/1986 | Feldman et al. | 174/50 |
| 4,654,470 | 3/1987 | Feldman et al. | 174/50 |

*Primary Examiner*—Andres Kashnikow
*Assistant Examiner*—Anthoula Pomrening
*Attorney, Agent, or Firm*—Richard L. Ward

[57] ABSTRACT

An integrated single dispenser assembly is disclosed for dispensing detergent and additive into the washing chamber of an appliance. A two-piece cover assembly is provided for covering at least one cavity of the detergent dispenser. The cover assembly is movable to effect dispensing of both detergent and additive by an actuator member isolated from the dispenser assembly but operably interconnected therewith. A labyrinth liquid seal arrangement is provided between the cover assembly and the detergent dispenser cavity.

39 Claims, 7 Drawing Sheets

DETERGENT-ADDITIVE DISPENSER

BACKGROUND OF THE INVENTION

This invention relates generally to the field of detergent and additive dispensers and more specifically to an integrated single dispenser assembly adapted to dispense detergent and at least one additive substance into the washing chamber of an appliance.

While individual dispensers for detergent and for additive are common in the appliance industry, there is a void in the area of dispensers wherein an integrated single dispenser housing is utilized to separately receive, store and dispense both detergent and an additive through a single actuator. Generally, the prior art teaches the use of one dispenser housing and actuator for detergent and another separate dispenser housing and actuator for an additive.

Prior art has shown separate dispensers operated by a single actuator but there has been no teaching of an integrated single dispenser assembly having a movable cover controlled by an actuator for sequentially dispensing both detergent and additive.

SUMMARY OF THE INVENTION

It is an object of the instant invention to provide an improved dispenser for use with a household appliance.

It is a further object of the instant invention to provide an integrated single dispenser assembly for dispensing both detergent and an additive.

It is a still further object of the instant invention to provide an integrated single dispenser assembly on a first mounting panel and an actuator on a second mounting panel operably interconnected with the dispenser assembly.

It is another object of the instant invention to provide an integrated single dispenser assembly having a detergent cavity cover operated for effecting detergent dispensing and additive dispensing.

It is yet another object of the instant invention to provide an integrated single dispenser assembly having a two-piece cover assembly.

It is still another object of the instant invention to provide an integrated single dispenser assembly with a labyrinth seal arrangement between the dispenser housing and cover assembly.

Briefly, the instant invention achieves these objects in a dispenser apparatus for a dishwasher having a front opening providing an access to a washing chamber and an access door with inner and outer panels and operable for opening and closing the access. Detergent dispensing apparatus is associated with the inner door panel and includes at least one cavity and a cover for effectively sealing the cavity. An additive dispensing mechanism is integral with the detergent dispensing apparatus and includes a container and a closure member for sealing the container Control apparatus is operable for sequentially actuating movement of the cover to effect detergent dispensing and for actuating movement of the closure member responsive to movement of the cover to effect additive dispensing.

Operation and construction of the detergent-additive dispenser and further objects and advantages thereof will become evident as the description proceeds and from an examination of the accompanying seven sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
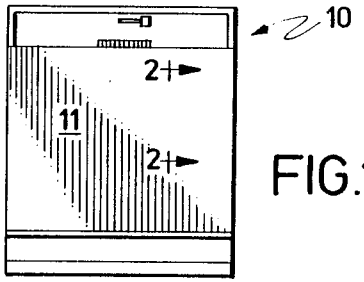
FIG. 1 is a front view of a household appliance such as a dishwasher including the detergent-additive dispenser of the instant invention.

Referring now to the drawings there is shown in FIG. 1 a household appliance such as a dishwasher 10. The dishwasher 10 of FIG. 1 is of the undercounter configuration having a front opening access door 11 for providing access to a washing chamber. While the dispenser 12 of the instant invention will be described in the environment of the front opening dishwasher 10 of FIG. 1, it is fully intended that this dispenser 12 could also be adapted for use with an automatic clothes washing machine or any other appliance requiring the dispensing of substances during a cycle of operations.

As the description of the detergent-additive dispenser proceeds, a plurality of component parts and assemblies will be described. Also, the operation of the detergent-additive dispenser will be described. Generally, the description will proceed through the following areas related to the detergent-additive dispenser of the instant invention: the detergent-additive dispenser housing, the additive dispensing assembly, the cover assembly, the cover seal arrangement, the actuating apparatus and the operation of the detergent-additive dispenser.

Detergent-Addition Dispenser Housing

Figure 2:
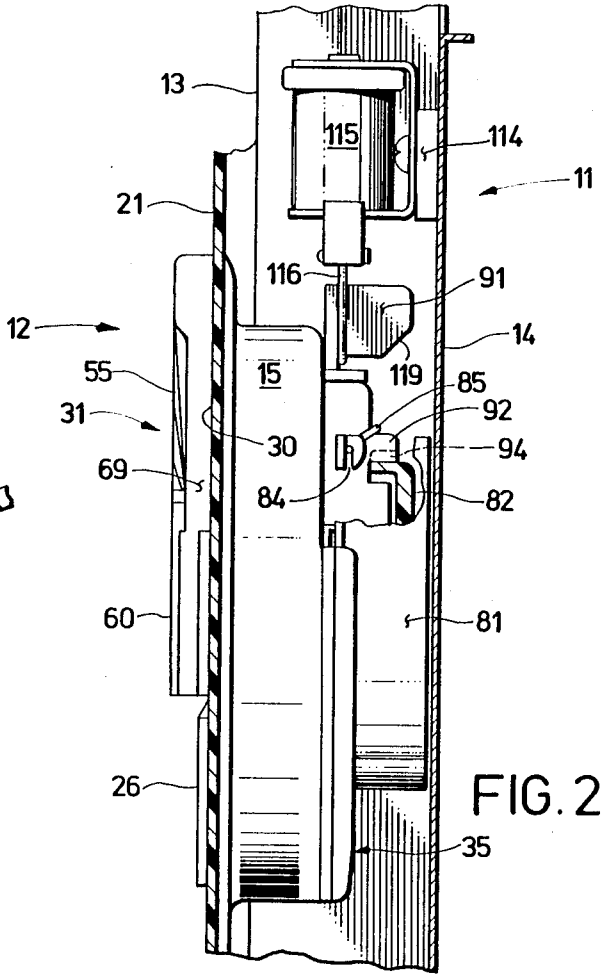
FIG. 2 is a vertical fragmentary section view taken generally along lines 2—2 of FIG. 1 and showing a partial cross section through the access door of the dishwasher.
Figure 3:
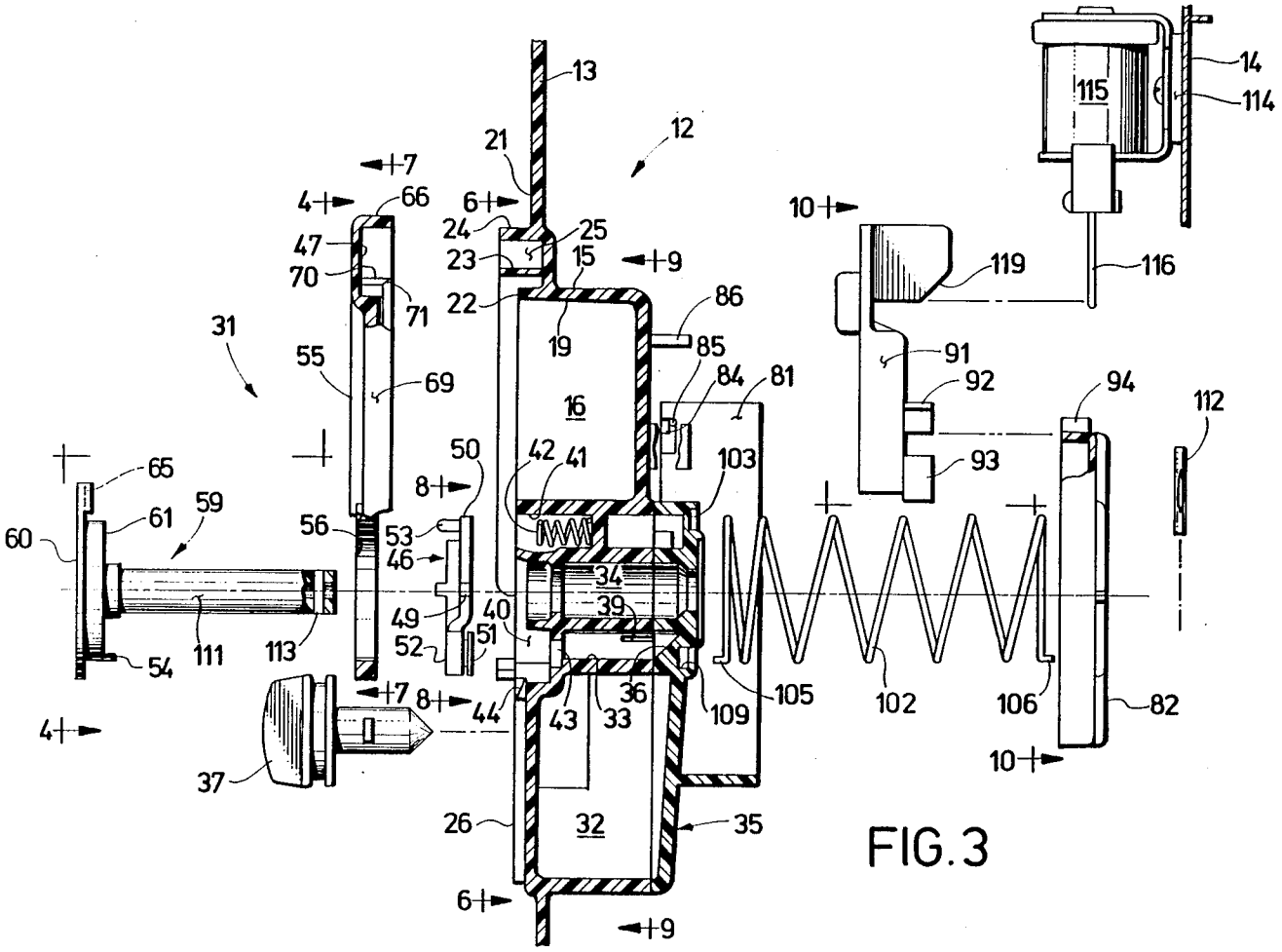
FIG. 3 is an exploded view of the detergent-additive dispenser mechanism shown in FIG. 2.

Turning to FIGS. 2 and 3 in particular, there is shown a fragmentary section view through the access door 11 of the dishwasher 10 and an exploded view of the dispenser 12. The access door 11 comprises an inner plastic door panel 13 and a sheet metal outer door panel 14 which are mechanically connected together As best shown in FIGS. 2, 3, 6 and 9, the plastic inner door panel 13 includes a detergent-additive dispenser housing 15 integrally molded in the inner door panel 13. While shown as an integral single detergent-additive dispenser housing 15 molded into the inner door panel 13 in this embodiment of the invention, it is contemplated that the detergent-additive dispenser housing 15 could alternatively be a separate molded housing fastened to the inner door panel 13.

Figure 6:
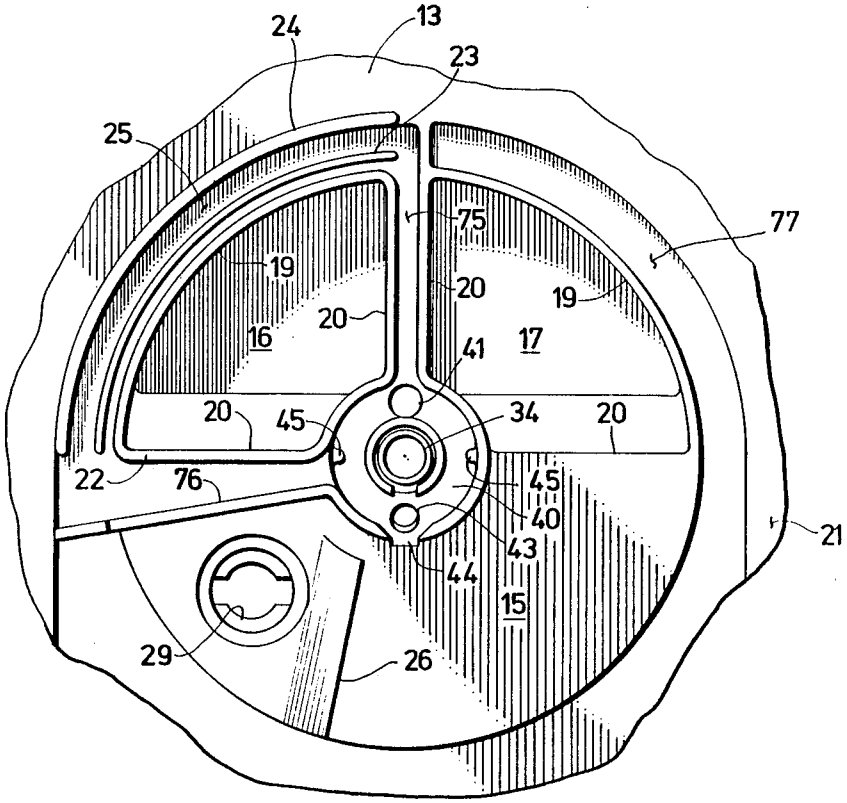
FIG. 6 is a frontal view of the detergent-additive dispenser without the cover of FIG. 4 and taken generally along lines 6—6 of FIG. 3.

The detergent-additive dispenser housing 15 as shown in FIG. 6 includes a pair of detergent holding compartments or cavities 16 and 17 perpendicular to and recessed from the planar surface 21 and each having an arcuate outer wall 19 and two other walls 20 defining the cavities 16 and 17 as segments of a circle. The upper edges of the arcuate outer wall 19 and walls 20 of the right-hand cavity 17, when viewed from within the washing chamber, are substantially at the same outer surface level as the planar surface 21 of the plastic inner door panel 13. The left-hand cavity 16 further includes a peripheral lip 22 which is perpendicular to and raised from the surface level of the planar surface 21. The right-hand cavity 17 is uncovered when the left-hand cavity 16 is covered and will hold or contain a first quantity of detergent which is exposed to the flushing action of washing fluid as a cycle of operations is undertaken. The initially covered left-hand cavity 16 will hold or contain a second quantity of detergent for later dispensing and it is desirable to keep the second quantity of detergent as dry as possible prior to dispensing.

Figure 11:
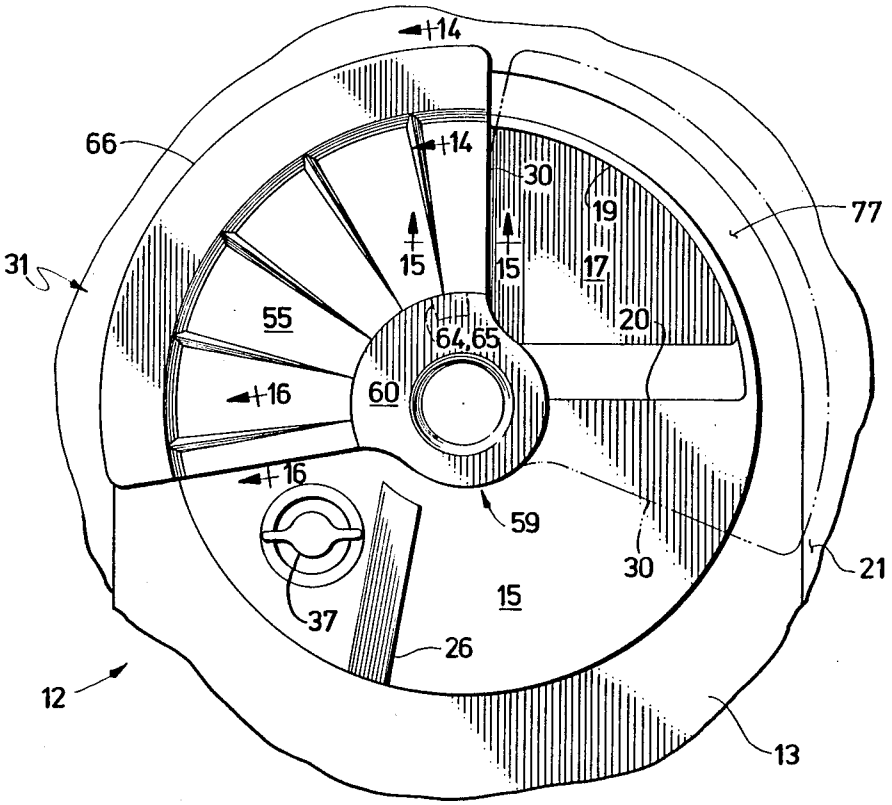
FIG. 11 is a front view of the assembled detergent-additive dispenser showing the cover in a first operating posture covering a detergent compartment and in a second dashed line operating posture for uncovering that detergent compartment.
Figure 12:
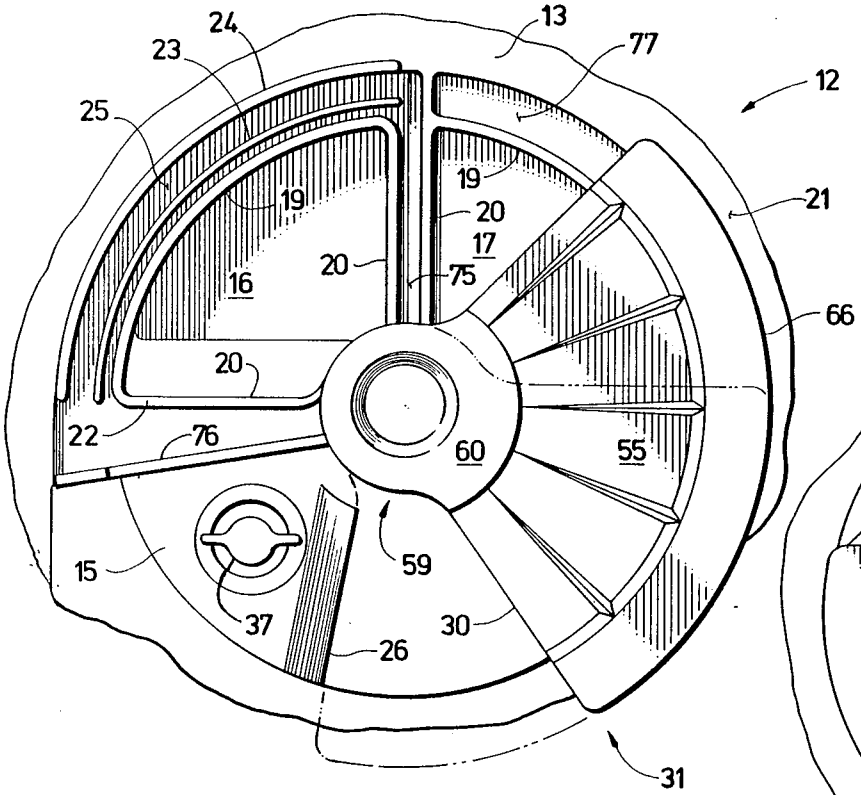
FIG. 12 is another front view of the assembled dispenser showing the cover in a third operating posture for actuating the additive dispenser and in a fourth dashed line posture for deactuating the additive dispenser.

Also shown in the lower left-hand quadrant of FIG. 6 is an additive fill opening 29. The additive fill opening 29 serves as an access for filling the additive holding container or chamber 32 best shown in FIGS. 3 and 9. As shown in FIGS. 3, 11 and 12, a fill plug 37 is received by the fill opening 29.

Figure 9:
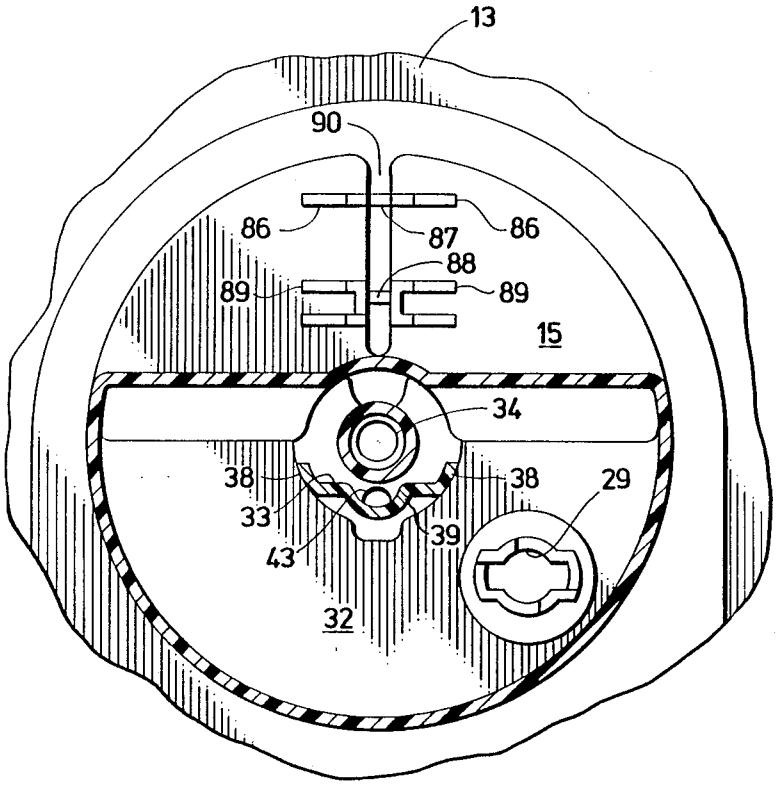
FIG. 9 is a rear view of the detergent-additive dispenser partially sectioned and taken generally along lines 9—9 of FIG. 3.

A portion of the additive holding chamber 32 is formed as an integral part of the detergent-additive dispenser housing 15 when the inner door panel 13 is molded. The additive holding chamber 32 is semicircular in configuration and substantially encompasses the lower quadrants of the detergent-additive dispenser housing 15. As can be seen in FIG. 9, a generally U-shaped additive metering trough 33 with upwardly extending sides 38 is molded just below the central bore 34 of the detergent-additive dispenser housing 15.

Figure 13:
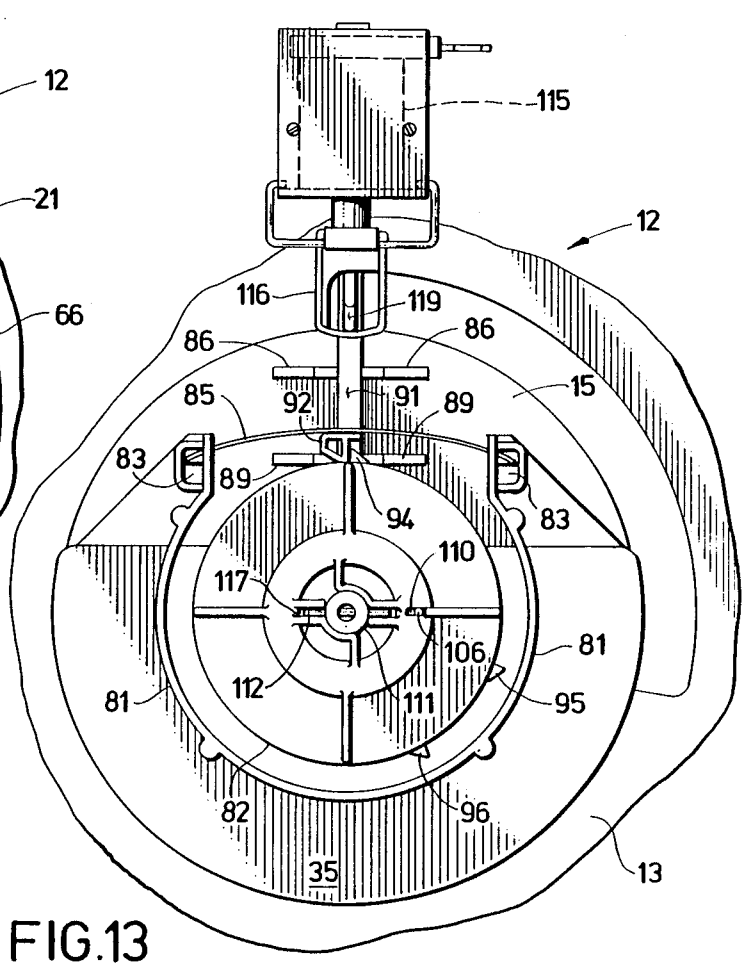
FIG. 13 is a rear view of the assembled detergent-additive dispenser.

As shown in FIGS. 2, 3 and 13, a holding chamber rear wall 35 is separately molded and is assembled over that portion of the additive holding chamber 32 associated with the inner door panel 13 and a seal is provided along the joint by welding or similar process to form a liquid retaining container As shown in FIG. 3, the holding chamber rear wall 35 provides the rear wall 36 of the metering trough 33 and the rear journal portion of the central bore 34 The metering trough 33 is charged to the full condition by liquid additive flowing over the sides 38 and into the trough 33 whenever the access door 11 of the dishwasher 10 is opened to a generally horizontal posture such as at the end of a dishwashing cycle As best shown in FIG. 3, the metering trough 33 further includes a diagonal slot 39 located at a predetermined height for draining excess additive back into the additive holding chamber 32. The excess additive will drain back into the additive holding chamber 32 through the diagonal slot 39 when the access door 11 is closed to a generally vertical posture thus providing a uniform amount of additive to be dispensed in each cycle

Additive Dispensing Assembly

Turning again to FIGS. 3 and 6, there is shown on the wash chamber side of the inner door panel 13, a molded recess 40 which is generally concentric with and adjacent to the central bore 34 of the detergent-additive dispenser housing 15. The recess 40 includes a cylindrical pocket 41 spaced above the central bore 34, with the access door 11 in the vertical position, for receiving a compression spring 42. The recess 40 further includes a passageway 43 spaced below the central bore 34 and in fluid communication with the metering trough 33 of the additive holding chamber 32. Immediately below the passageway 43 is a drain spout 44 for guiding additive away from the passageway 43 and into the washing chamber As best shown in FIG. 6, a pair of pivot lugs 45 are included in the bottom of the recess 40 on either side of the central bore 34 and are spaced at 90° from the cylindrical pocket 41 and passageway 43.

Figure 8:
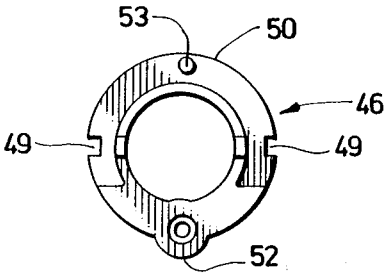
FIG. 8 is a front view of an additive dispensing washer taken along lines 8—8 of FIG. 3.

Referring now to FIGS. 3 and 8, there is shown a tilting washer or lever 46 which is received in the recess 40 in generally coaxial relationship to the central bore 34 of the detergent-additive dispenser housing 15. The tilting washer 46 has a pair of side notches 49 which are engageable with the pivot lugs 45 shown in FIG. 6. The tilting washer 46 normally rests in the recess 40 with the compression spring 42 biasing the upper end 50 toward the cover assembly 31. This biasing tends to pivot the tilting washer 46 about the pivot lugs 45 and will bias the rubber seal 51 attached to the lower end 52 of the tilting washer 46 into scaling engagement with the passageway 43. The biased upper end 50 of the tilting washer 46 includes a follower pin 53 which is engageable with a ramp shaped actuator cam 54 associated with the support portion 59 of the cover assembly 31 and will be further discussed herein.

Cover Assembly

As best shown in FIGS. 3, 4, 5 and 7 the detergent-additive dispenser 12 of the instant invention includes a two-piece cover assembly 31 for normally covering the left-hand cavity 16. The cover assembly 31 is rotatably movable for uncovering the left-hand cavity 16 to effect the dispensing of detergent in a first step and for effecting the dispensing of additive in another step. The cover assembly 31 includes a generally flat wedge shaped cover portion 55 which overlies the peripheral lip 22 of the left-hand cavity 16. The wedge shaped cover portion 55 includes an annular opening 56 which is concentric with the central bore 34 of the detergent-additive dispenser housing 15 when assembled thereon.

The cover assembly 31 further includes a support portion 59 which extends through the annular opening 56 of the wedge shaped cover portion 55 and is journaled within the central bore 34 of the detergent-additive dispenser housing 15. The support portion 59 has a first annular flange 60 which overlies the annular opening 56 in the wedge shaped cover portion 55 and captures the wedge shaped cover portion 55 with respect to the detergent-additive dispenser housing 15. A second smaller annular flange 61 is effectively journaled within the annular opening 56 of the wedge shaped cover portion 55 and includes the ramp shaped actuator cam 54 which is engageable with the follower pin 53 of the tilting washer 46.

Figure 4:
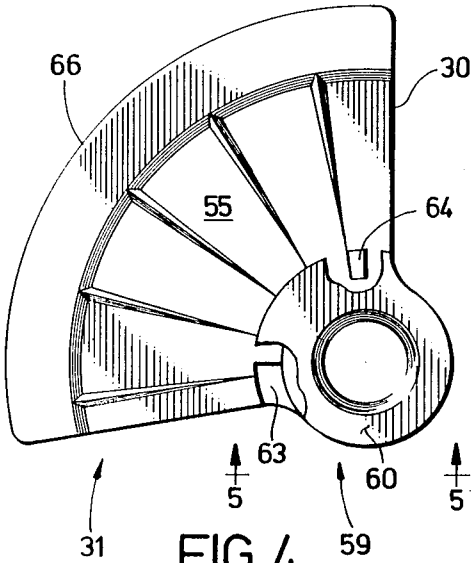
FIG. 4 is a view of the dispenser cover taken substantially along lines 4—4 of FIG. 3.
Figure 5:
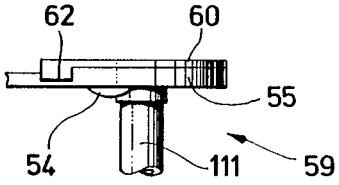
FIG. 5 is a partial side view of the dispenser cover of FIG. 4.

Referring to FIG. 5, it can be seen that the first annular flange 60 associated with the support portion 59 includes a drive lug 62. As best shown in FIG. 4, the drive lug 62 is engageable with a drive notch 63 formed in the wedge shaped cover portion 55 of the cover assembly 31. The drive lug 62 will effect clockwise driving movement of the wedge shaped cover portion 55 when the support portion 59 rotates. As further shown in FIG. 4, the wedge shaped cover portion 55 has a tapering raised element forming a detent 64 which is engageable with a tapering recessed notch 65 in the first annular flange 60 of the support portion 59 as shown in dashed lines in FIG. 11.

With the two-piece construction of the cover assembly 31, it is possible for the appliance operator to manually rotate the wedge shaped cover portion 55 in the clockwise direction without rotation of the support portion 59, as shown in dashed lines in FIG. 11, by overcoming the detent 64. This movement of the wedge shaped cover portion 55 of the cover assembly 31 independently of rotation of the support portion 59 allows the condition of the left-hand cavity 16 to be monitored at any time during a cycle of operations. This selective independent movement is an important feature since the support portion 59 of the cover assembly 31 includes the ramp shaped actuator cam 54 which is engageable with the follower pin 53 of the tilting washer 46 for effecting the dispensing of additive into the washing chamber. Without rotation of the support portion 59 the actuator cam 54 will not engage the follower pin 53 and additive will not be dispensed.

Cover Seal Arrangement

Referring to FIG. 6, there are shown a pair of arcuate wall members 23 and 24 which are molded generally parallel to the arcuate outer edge 19 of the left-hand cavity 16. The pair of arcuate wall members 23 and 24 together define a C-shaped channel 25 extending beyond or raised from the planar surface 21 of the inner door panel 13 beyond the peripheral lip 22.

The two-piece cover assembly 31 forms a unique seal arrangement in cooperation with the left-hand cavity 16. This seal arrangement will be described in conjunction with drawing FIGS. 3, 6, 7 and 14–16. With most detergent cup arrangements presently in use, a relatively flat cover directly overlies a detergent holding cavity. In these prior art designs, capillary action can carry washing fluid past the contact point between the cover and cavity and into the cavity where the contained detergent will soak up the washing fluid.

Figure 14:
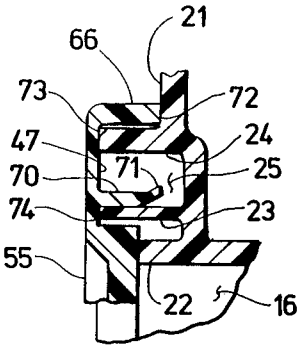
Figure 7:
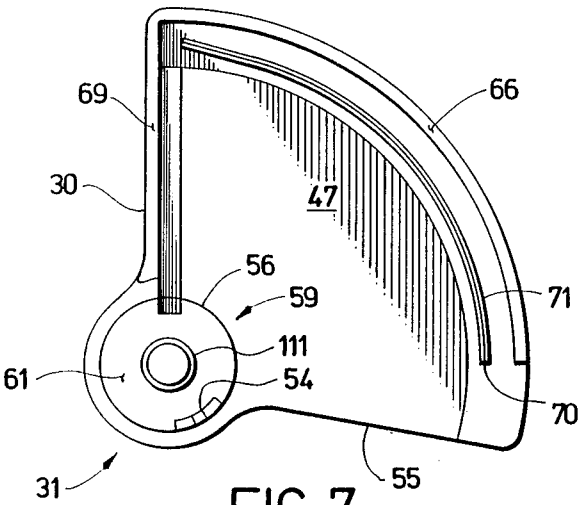
FIG. 7 is a rear view of the dispenser cover taken generally along lines 7—7 of FIG. 3.

As best shown in FIG. 7, the rear 47 of the wedge shaped cover portion 55 of the cover assembly 31 includes an arcuate outer lip 66 which, as shown in FIG. 14, overlies the arcuate wall members 23 and 24 of the C-shaped channel 25 when assembled to the dispenser housing 15. As further shown in FIG. 14, the lip 66 is generally contiguous with the planar surface 21 of the inner door panel 13.

Figure 15:
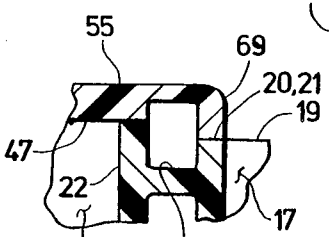

As further shown in FIG. 7, the arcuate outer lip 66 continues in a side lip 69 which, as shown in FIGS. 2 and 3, extends along the right-hand side of the wedge shaped cover portion 55 of the cover assembly 31 and generally toward the central bore 34 of the detergent-additive dispenser housing 15. The side lip 69, as shown in FIG. 15, is also generally contiguous with the planar surface 21 of the inner door panel 13. As further shown in FIG. 7, the rear 47 of the wedge shaped cover portion 55 further includes an arcuate ledge 70. The arcuate ledge 70 extends into the space between and is generally parallel to the arcuate wall members 23 and 24 of the C-shaped channel 25 as in FIG. 14. The arcuate ledge 70 has an upturned edge 71 adjacent the bottom of the C-shaped channel 25 for guiding washing fluid as further shown in FIG. 14.

Turning now specifically to FIG. 14, the arcuate wall members 23 and 24 of the C-shaped channel 25 are generally contiguous with that portion of the rear 47 of the wedge shaped cover portion 55 which contains the arcuate outer lip 66 and the arcuate ledge 70. The outer lip 66 and the side lip 69 of FIG. 15 are in substantially line-to-line contact with the planar surface 21 of the inner panel 13 thus forming three contact points 72–74 that washing fluid must pass in order to comingle with the detergent in the left-hand cavity 16.

As further shown in FIG. 14, any washing fluid leaking past the contact points 72 and 73 will follow the vertical surface of the rear 47 of the wedge shaped cover portion 55 of the cover assembly 31 to the arcuate ledge 70. The upturned edge 71 of the arcuate ledge 70 and surface tension will tend to keep washing fluid from flowing over the upturned edge 71 so that washing fluid will follow the arcuate ledge 70 and drain out the lower left side of the cover assembly 31. In addition, the arcuate wall member 23 of the C-shaped channel 25 and peripheral lip 22 provide guidance for any overspill from the arcuate ledge 70 to the left side of the cover assembly 31.

As further shown in FIG. 15, and as previously discussed, the side lip 69 of the wedge shaped cover portion 55 of the cover assembly 31 is generally contiguous with the plane of the arcuate outer wall 19 and walls 20 of the right-hand cavity 17. It is again noted that the planar surface 21 is at the same surface level as the upper edges of the arcuate outer wall 19 and walls 20 of the right-hand cavity 17. As shown in FIGS. 6 and 11, an arcuate trough 77 is formed in the inner door panel 13 on the right-hand side of the dispenser 12 in a plane recessed from or spaced below the common level of the planar surface 21 and the upper boundaries of the right-hand cavity 17. This trough 77 provides a path for washing fluid and food debris to follow away from the area adjacent the right-hand cavity 17. As best shown in FIG. 6, which depicts the access door 11 in a vertical posture, a vertical duct 75 is formed in the detergent-additive dispenser housing 15 in the same plane as the bottom of the C-shaped channel 25. Any washing fluid passing between the side lip 69 and the planar surface 21 will be directed down the duct 75 and into the recess 40 of the detergent-additive dispenser housing 15.

Figure 16:
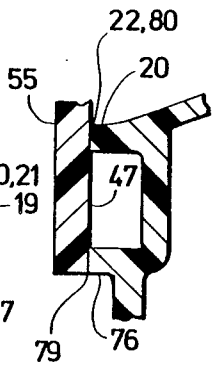
FIGS. 14, 15 and 16 are fragmentary section views taken generally along lines 14—14, 15—15 and 16—16 of FIG. 11 and shown out of order on the first sheet of drawings.

In FIG. 16, the lower left portion of the wedge shaped cover portion 55 of the cover assembly 31 also includes dual point contacts 79 and 80. A wall 76 slopes downwardly away from the recess 40 as shown in FIG. 6 and forms a first contact point 79 with the rear 47 of the wedge shaped cover portion 55. As further shown in FIG. 16, if washing fluid penetrates this first contact point 79, it will either drain out or follow the downwardly sloping wall 76 and drain at the left side. Again, the wedge shaped cover portion 55 of the cover assembly 31 is cooperable with the peripheral lip 22 of the left-hand cavity 16 to form a second contact point 80. Thus, the left-hand cavity 16 is provided with a baffle or labyrinth seal arrangement providing protection for detergent contained in the cavity 16. The labyrinth seal arrangement provides this protection without the use of gasketing and permits non-binding movement of the cover 31 relative to the planar surface 21 of the detergent-additive dispenser housing 15.

Actuating Apparatus

Turning now to FIGS. 2, 3 and 13, that portion of the detergent-additive dispenser 12 which is located between the plastic inner door panel 13 and the sheet metal outer door panel 14 will be described. As previously discussed, a holding chamber rear wall 35 forms the rear of the additive holding chamber 32. The holding chamber rear wall 35 includes a rearwardly extending semicircular wall 81 which is generally coaxial with the central bore 34 of the detergent-additive dispenser housing 15 and substantially surrounds an actuator wheel 82 As best shown in FIG. 2, the semicircular wall 81 effectively protects the actuator wheel 82 from contact by the outer door panel 14. Referring to FIG. 13, the semicircular wall 81 includes a pair of box-like retainers 83, one on each side of the vertical center line of the dispenser housing 15. As best shown in FIGS. 2 and 3, the retainers 83 have openings 84 for receiving the ends of a leaf spring 85 formed from spring wire.

The detergent-additive dispenser housing 15 also includes, as best shown in FIGS. 9 and 13, top and bottom pairs of guide rails 86 and 89 which extend rearward from the dispenser housing 15. As shown in FIG. 9, ribs 87 and 88 interconnect the guide rails and cooperate therewith to form a guide path 90 for an elongated generally rectangular slider 91 best shown in FIG. 3. The slider 91 comprises part of the cover actuating mechanism and is movable back and forth within the guide path 90. The slider 91 is engaged by the leaf spring 85 as shown in FIGS. 2 and 13 and is biased in a downward direction thereby. The slider 91 includes first and second catches 92 and 93 which are engageable with external stop lugs 94-96 and internal stop lugs 99 and 100 associated with the actuator wheel 82 and shown in FIG. 10.

Figure 10:
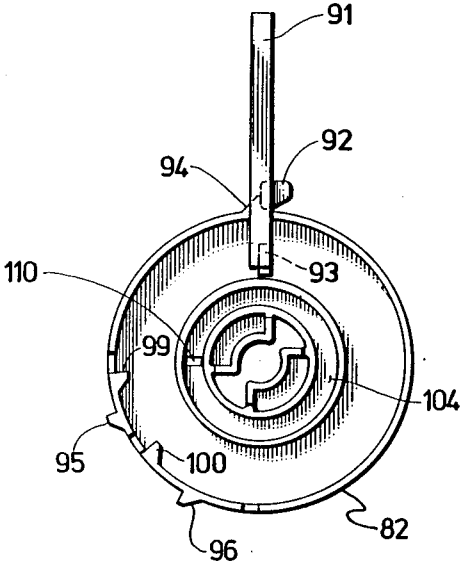
FIG. 10 is a view of a slider and actuator wheel arrangement taken generally along lines 10—10 of FIG. 3.

Referring now to FIG. 3 in particular, the support portion 59 of the cover assembly 31 extends through the central bore 34 of the detergent-additive dispenser housing 15. A combination compression-torsion spring 102 is compressed between an annular groove 103 in the holding chamber rear wall 35 and an annular groove 104 in the actuator wheel 82 as shown in FIG. 10. The ends 105 and 106 of the spring 102 are inserted into slots 109 and 110 formed in the annular groove 103 of the holding chamber cover 35 and in the annular groove 104 of the actuator wheel 82 respectively of FIGS. 3 and 13 for torsionally capturing the spring 102. The slider 91 is placed in the guide path 90 and the actuator wheel 82 is assembled over the spring 102 and onto the shaft 111 of the support portion 59.

As further shown in FIGS. 3 and 13, a drive pin 112 extends through a transverse aperture 113 formed in the shaft 111 and is captured by the actuating wheel 82 through a part turn movement of the actuating wheel 82. This movement locates the drive pin 112 in a groove 117 formed in the actuator wheel 82 and as shown in FIG. 13. Once the components shown in FIG. 3 have been assembled to form the detergent-additive dispenser 12, the plastic inner door panel 13 is assembled to the sheet metal outer door panel 14.

As shown in FIGS. 2 and 3, the outer door panel 14 has a mounting platform 114 formed inwardly toward the inner door panel 13. Mounted on the platform 114 above the dispenser 12 is a solenoid 115, in this embodiment, which is mechanically connected to the slider 91 by way of a U-shaped connector link 116. The slider 91 has a chamfered edge 119 which engages with the connector link 116 during assembly of the inner and outer door panels 13 and 14 and guides the connector link 116 onto the slider 91.

Figure 17:
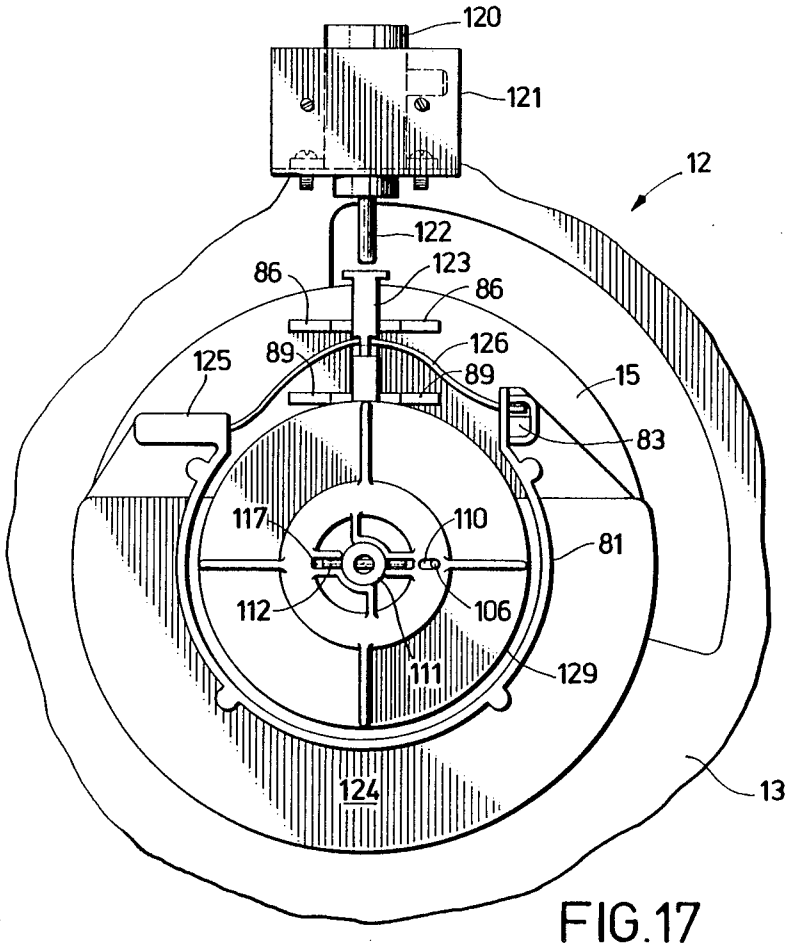
FIG. 17 is a view similar to FIG. 13 showing a second actuator embodiment.

Turning now to FIG. 17, there is shown a second actuator embodiment. In this second embodiment, a thermally responsive wax motor actuator 120 is attached to a mounting bracket 121 which is secured to the mounting platform 114. The wax motor actuator 120 has a plunger 122 which moves in a downward direction toward the slider 123 when the wax motor actuator 120 is energized. The downward movement of the plunger 122 is opposite the upward movement of the connector link 116 and slider 91 when the solenoid 115 of the first embodiment is energized. The opposite direction of actuation of the wax motor actuator 120 from the solenoid 115 necessitates some minor differences in the associated operating components.

Figure 18:
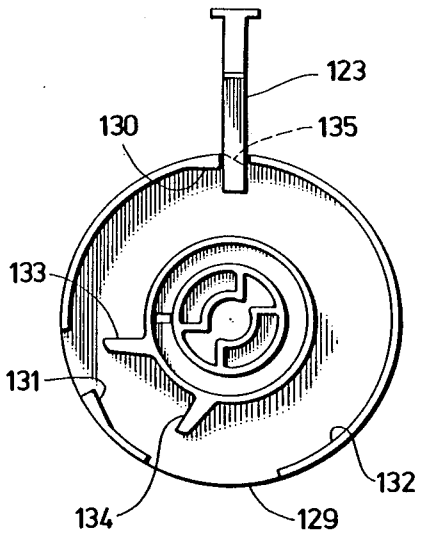
FIG. 18 is a view similar to FIG. 10 showing the slider and actuator wheel of the second actuator embodiment.

Referring to FIG. 18 along with FIG. 17, is noted that a very apparent and important difference is that the plunger 122 will directly contact the top of the slider 123 during actuation and thus the connector link 116 of FIG. 3 is eliminated. The holding chamber rear wall 124 in FIG. 17 of the second embodiment has a spring recess 125 on the left side and a box-like retainer 83 on the right side The spring recess 125 effectively captures one end of a spring wire leaf spring 126 designed to engage with and upwardly bias the slider 123 toward the plunger 122.

Referring again to FIG. 18, it can be seen that the actuator wheel 129 used with the wax motor actuator 120 includes a pair of stops 130 and 131 associated with the rim 132 of the actuator wheel 129 and a pair of abutments 133 and 134. These stops 130 and 131 and abutments 133 and 134 are engageable with a latch portion 135 of the slider 123 as the wax motor actuator 120 is energized at appropriate times during a cycle of operations as will be further discussed herein.

There is thus provided a unique dispenser actuator arrangement wherein an actuator device such as the solenoid 115 or a thermally responsive wax motor 120 are physically mounted and electrically isolated from the detergent-additive dispenser housing 15 on a different panel. Further, the connection and disconnection or operational alignment of the actuator device comprising the solenoid 115 or wax motor 120 and the detergent-additive dispenser 12 is automatically accomplished upon assembly and disassembly of the inner and outer door panels 13 and 14.

Operation

FIGS. 10 and 13 show the posture of the slider 91 and actuator wheel 82 of the first actuator embodiment when the cover 31 is in the full line posture of FIG. 11 completely covering the left-hand cavity 16 for containing detergent therein. In this posture, the spring 102 has been wound so that the cover assembly 31 will be biased for rotation to uncover cavity 16 and to actuate the tilting washer 46 to dispense additive. Initial energization of the solenoid 115 will move the slider 91 upwardly in the guide path 90 to release the first catch 92 from the first external stop lug 94 of the actuator wheel 82. Upon release of the first catch 92, the actuator wheel 82 and cover assembly 31 will be biased by the spring 102 to impart counter-clockwise rotation of both the wedge shaped cover portion 55 and the support portion 59 of the cover assembly 31 as viewed from the perspective of FIG. 13 The actuator wheel 82 will rotate until the first internal stop lug 99 engages the second catch 93 of the slider 91. When the solenoid 115 is deenergized, the leaf spring 85 will bias the slider 91 downward to release the second catch 93 from the first internal lug 99 and allow the first catch 92 to engage the second external lug 95. The corresponding posture of the wedge shaped cover portion 55 of the cover assembly 31 is shown in dashed lines in FIG. 11 and the left-hand cavity 16 is uncovered for dispensing the second quantity of detergent.

A second energization of the solenoid 115 will lift the slider 91 to disengage the first catch 92 from the second external lug 95 and permit additional rotation of the actuator wheel 82 and cover assembly 31 by the spring 102. Rotation will stop when the second catch 93 engages the second internal stop lug 100 of the actuator wheel 82. Subsequent deenergization of the solenoid 115 will again allow the leaf spring 85 to bias the slider 91 downward and release the second catch 93 from the second internal stop lug 100. The corresponding posture of the wedge shaped cover portion 55 of the cover assembly 31 is the solid line posture shown in FIG. 12. Movement of the cover assembly 31 to this posture engages the actuator cam 54 with the follower pin 53 of the tilting washer 46. This engagement will pivot the tilting washer 46 about the pivot lugs 45 and will move the rubber seal 51 from the passageway 43 permitting additive to flow from the metering trough 33 into the washing chamber In this posture of the cover assembly 31, the passageway 43 will remain open.

A third energization of the solenoid 115 will disengage the first catch 92 from the third external stop lug 96. This action will allow the spring 102 to rotate the actuator wheel 82 and the cover assembly 31 to the dashed line posture of FIG. 12 where the wedge shaped cover portion 55 of the cover assembly 31 will stop against the abutment 26. This final movement of the cover assembly 31 will disengage the actuator cam 54 from the follower pin 53 which will allow the spring 42 to bias the rubber seal 51 into sealing engagement with the passageway 43. Sealing the passageway 43 in this manner will permit opening of the access door 11 during a cycle after the additive has been dispensed into the wash chamber but prior to completion of a cycle without losing additive even though the metering trough 33 is automatically refilled as the access door 11 is opened.

FIGS. 17 and 18 show the posture of the slider 123 and actuator wheel 129 of the second actuator embodiment when the cover 55 is in the full line posture of FIG. 11 completely covering the left-hand cavity 16 for containing detergent therein. Initial energization of the wax motor actuator 120 will move the slider 123 downwardly in the guide path 90 to release the latch portion 135 of the slider 123 from the first stop 130 of the actuator wheel 129. Upon release of the latch portion 135, the actuator wheel 129 and the cover assembly 31 will be biased by the spring 102 to impart counterclockwise rotation of both the wedge shaped cover portion 55 and the support portion 59 as viewed from the perspective of FIG. 17. The actuator wheel 129 will rotate until the first abutment 133 engages the latch portion 135 of the slider 123. When the wax motor actuator 120 is deenergized, the wire leaf spring 126 will bias the slider 123 upward toward the plunger 122 to release the latch portion 135 from the first abutment 133 and allow the latch portion 135 to engage the second stop 131. The corresponding posture of the wedge shaped cover portion 55 is shown in dashed lines in FIG. 11 and the left-hand cavity 16 is uncovered for dispensing the second quantity of detergent.

A second energization of the wax motor actuator 120 will again move the slider 123 downwardly to disengage the latch portion 135 from the second stop 131 and permit additional rotation of the actuator wheel 129 and cover assembly 31 by the spring 102. Rotation will stop when the latch portion 135 engages the second abutment 134 of the actuator wheel 129. The corresponding posture of the wedge shaped cover portion 55 is the solid line posture of FIG. 12. Movement of the cover assembly 31 to this posture engages the actuator cam 54 with the follower pin 53 of the tilting washer 46. This engagement will pivot the tilting washer 46 about the pivot lugs 45 and will move the rubber seal 51 from the passageway 43 permitting additive to flow from the metering trough 33 into the washing chamber. Deenergization of the wax motor actuator 120 will again allow the wire leaf spring 126 to bias the slider 123 upward to release the latch portion 135 from the second abutment 134. Upon deenergization, the plunger 122 of the wax motor actuator 120 does not immediately return to the posture of FIG. 17. The plunger 122 retracts as the wax motor actuator 120 cools and due to upward biasing from the wire leaf spring 126. The short delay in return allows the additive to be washed into the washing chamber and when the latch portion 135 is released from the second abutment 134 the cover assembly 31 will move to the dashed line posture of FIG. 12 where the wedge shaped cover portion 55 is stopped against the abutment 26. In this posture the rubber seal 51 on the tilting washer 46 is in sealing engagement with the passageway 43 as previously discussed.

There has thus been shown and described herein an improved detergent-additive dispenser for use with an appliance such as a dishwasher. This improved detergent-additive dispenser utilizes an integrated single dispenser assembly which is adapted for dispensing both detergent and additive. An improved seal arrangement is employed for protecting contained detergent from contamination by washing fluid and a two-piece cover is controlled for movement to sequentially dispense both detergent and additive The dispenser housing is associated with one access door panel and the dispenser actuator is mounted on another spaced-apart access door panel with operating linkage provided between the controlled cover mounted on the housing and the actuator.

In the drawings and specification, there has been set forth a preferred embodiment of the invention and although specific terms are employed, these are used in a generic and descriptive sense only and not for purposes of limitation. Changes in the form and proportion of parts as well as the substitution of equivalents are contemplated as circumstances may suggest or render expedient without departing from the spirit or scope of the invention as further defined in the following claims.

I claim:

1. Dispenser apparatus for a dishwasher having a front opening providing an access to a washing chamber, an access door with inner and outer panels and operable for opening and closing the access, comprising detergent dispensing means on said inner panel including at least one cavity and cover means for effectively sealing said cavity; additive dispensing means on said inner panel integrated with said detergent dispensing means and including a container and closure means for sealing said container; and control means for sequentially actuating movement of said cover means to effect detergent dispensing and for actuating movement of said closure means responsive to movement of said cover means to effect additive dispensing.

2. Dispenser apparatus as defined in claim 1 wherein said control means includes actuator means on said outer door panel and interconnecting means between said actuator means and said cover means.

3. Dispenser apparatus as define in claim 1 wherein the closure means of said additive dispensing means includes a lever member responsive to movement of said cover means for actuation from a sealing position to a dispensing position.

4. Dispenser apparatus as defined in claim 1 wherein said cover means includes a two-piece cover assembly.

5. Dispenser apparatus as defined in claim 1 wherein said detergent dispensing means includes labyrinth seal means for effectively preventing washing liquid from entering said cavity with said cover means in a closed position.

6. Dispenser apparatus as defined in claim 1 wherein said inner panel is molded of plastic and said cavity and container are integrally formed as a unit.

7. Dispenser apparatus for a dishwasher having a front opening providing an access to a washing chamber, an access door with inner and outer panels and operable for opening and closing the access, comprising: detergent dispensing means on said inner panel including at least one cavity and cover means for effectively sealing said cavity; additive dispensing means on said inner panel integrated with said detergent dispensing means and including a container and closure means for sealing said container; and control means including actuator means on said outer panel and interconnecting means between said actuator means and said cover means, said actuator means operable for sequentially actuating movement of said cover means to effect detergent dispensing and for actuating movement of said closure means responsive to movement of said cover means to effect additive dispensing.

8. Dispenser apparatus as defined in claim 7 wherein said actuator means includes a thermally responsive wax motor.

9. Dispenser apparatus as defined in claim 7 wherein said actuator means includes a solenoid.

10. Dispenser apparatus as defined in claim 7 wherein said inner panel is molded of plastic and said cavity and container are formed as a unit.

11. Dispenser apparatus for a dishwasher having a front opening providing an access to a washing chamber, an access door having a first door panel facing the interior of the washing chamber and a second door panel spaced outwardly from the first door panel, comprising: detergent dispensing means on said first door panel including at least one cavity and cover means for effectively sealing said cavity; additive dispensing means on said first door panel integrated with said detergent dispensing means and including a container and closure means for sealing said container; means for operating said detergent dispensing means and said additive dispensing means; and control means including actuator means on said second door panel and interconnecting means having a first portion attached to one of said actuator means and said operating means and a second portion removably associated with the other of said actuator means and said operating means for linking said actuator means on said second door panel with said cover means, said interconnecting means automatically connected and disconnected responsive to the assembly and disassembly of said first door panel to said second door panel.

12. Dispenser apparatus as defined in claim 11 wherein said first door panel is formed from a plastic material and said second door panel is formed from sheet metal.

13. Dispenser apparatus as defined in claim 11 wherein said actuator means includes a solenoid.

14. Dispenser apparatus as defined in claim 13 wherein said actuator means is effectively electrically isolated from said dispenser apparatus but is operatively connected thereto by said interconnecting means.

15. Dispenser apparatus for a dishwasher having a front opening providing an access to a washing chamber, an access door having a plastic door panel facing the interior of the washing chamber and a metal door panel spaced outwardly from the plastic door panel and means for mounting the plastic door panel thereon, comprising: detergent dispensing means including at least one detergent holding cavity molded into said plastic door panel and cover means for effectively sealing said cavity; additive dispensing means molded into said plastic door panel with said detergent dispensing means and including a container and closure means for sealing said container; and control means including an actuator mounted on said metal door panel and means for providing interpanel operational connection of said actuator on said metal door panel with said cover means responsive to the assembly of said plastic door panel to said metal door panel.

16. Dispenser apparatus for a dishwasher having a front opening providing an access to a washing chamber, an access door with inner and outer panels and operable for opening and closing the access, comprising: detergent dispensing means on said inner panel including at least one cavity and cover means for effectively sealing said cavity; additive dispensing means on said inner panel integrated with said detergent dispensing means and including a container and closure means comprising a biased lever member having a seal for sealing said container; and control means for sequentially actuating movement of said cover means to effect detergent dispensing and for actuating movement of said lever member responsive to movement of said cover means to effect actuation of said lever member from a sealing position to a dispensing position.

17. Dispenser apparatus for a dishwasher having a front opening providing an access to a washing chamber, an access door with inner and outer panels and operable for opening and closing the access, comprising: detergent dispensing means on said inner panel having at least one cavity and cover means for effectively sealing said cavity; additive dispensing means on said inner panel including a container integrated with said detergent dispensing means and closure means for sealing said container, said additive dispensing means further including a recess beneath said cover means and means defining a passageway between said container and said recess, said closure means including seal means disposed within said recess for sealing said passageway to prevent leakage of additive from said container; and control means for sequentially actuating movement of said cover means to effect detergent dispensing and for actuating movement of said seal means from a sealing position to a dispensing position responsive to movement of said cover means.

18. Dispenser apparatus as defined in claim 17 wherein said seal means further includes a lever and wherein one of said lever and said recess includes a pivot with said lever movable about said pivot responsive to movement of said cover means to open said passageway for dispensing additive from said container.

19. Dispenser apparatus as defined in claim 18 wherein said cover means includes a cam and said closure means includes a follower cooperable with said cam for effecting said lever movement.

20. Dispenser apparatus for a dishwasher the dishwasher having a front opening providing an access to a washing chamber, an access door with a plastic inner panel and a sheet metal outer panel and operable for opening and closing the access, comprising: detergent dispensing means having at least one cavity molded into said inner panel and cover means for effectively sealing said cavity; additive dispensing means on said inner panel including a container integrated with said detergent dispensing means and closure means for sealing said container, said additive dispensing means further including a recess subjacent said cover means and means defining a passageway between said container and said recess, said closure means including a tilting washer in said recess having a seal portion pivotally biased toward said passageway; and control means for sequentially actuating movement of said cover means to effect detergent dispensing and for actuating movement of said tilting washer responsive to movement of said cover means to effect pivotal movement of said tilting washer to open said passageway and dispense additive.

21. Dispenser apparatus as defined in claim 20 wherein said additive dispensing means further includes a generally U-shaped metering trough within said container adjacent said passageway for measuring a predetermined quantity of additive, said metering trough being automatically refilled responsive to opening of said access door.

22. Dispenser apparatus as defined in claim 21 wherein said metering trough includes means for returning additive in excess of said predetermined quantity to said container.

23. Dispenser apparatus for a dishwasher, the dishwasher having a front opening providing an access to a washing chamber, an access door with a plastic inner panel and a sheet metal outer panel and operable for opening and closing the access, comprising: detergent dispensing means having at least one cavity molded into said inner panel and cover means for effectively sealing said cavity; additive dispensing means on said inner panel including a container integrated with said detergent dispensing means and a metering trough within said container for temporarily holding a predetermined quantity of additive and closure means for sealing said container, said additive dispensing means further including a recess subjacent said cover means and means defining a passageway between said container and said recess, said closure means including a tilting washer in said recess having a seal portion pivotally biased toward said passageway; and control means for sequentially actuating movement of said cover means to effect movement of said tilting washer responsive to movement of said cover means including a cam on said cover means and a follower on said tilting washer for effecting pivotal movement of said tilting washer for moving said seal portion to open said passageway and dispense additive.

24. Dispenser apparatus as defined in claim 23 including means whereby said metering trough is automatically filled responsive to opening said access door and excess additive is returned to said container responsive to closing said access door.

25. Dispenser apparatus for a dishwasher having a front opening providing an access to a washing chamber, an access door with inner and outer panels and operable for opening and closing the access, comprising: detergent dispensing means on said inner panel including at least one cavity and cover means for effectively sealing said cavity; additive dispensing means on said inner panel integrated with said detergent dispensing means and including a container and closure means for sealing said container; and control means for sequentially actuating movement of said cover means to effect detergent dispensing and for actuating movement of said closure means responsive to movement of said cover means to effect additive dispensing, said cover means including a two-piece cover assembly rotatable as a unit in a first driven direction and having a selectively manually disengageable cover portion.

26. Dispenser apparatus as defined in claim 25 wherein said two-piece cover assembly includes a support portion journaled into said dispenser apparatus and said cover portion captured between a surface of said inner panel and said support portion.

27. Dispenser for a dishwasher having a front opening providing an access to a washing chamber, an access door with inner and outer panels and operable for opening and closing the access, comprising: detergent dispensing means having a housing on said inner panel including a plurality of detergent holding cavities; additive dispensing means on said inner panel integrated with said detergent dispensing means and including a container and closure means for sealing said container, said detergent dispensing means including a rotatable cover assembly including support portion rotatably journaled in said housing and a cover portion for covering and effectively sealing at least one of said detergent holding cavities, said cover portion drivingly coupled to said support portion; and control means for sequentially actuating movement of said cover assembly to effect detergent dispensing and for actuating movement of said closure means responsive movement of said cover assembly to effect additive dispensing, said cover portion of cover assembly rotatable with said support portion and selectively manually disengageable from said support portion for rotation independent of rotation of said support portion.

28. Dispenser apparatus as defined in claim 27 wherein said support portion of said cover assembly includes a flange in overlying engagement with said cover portion for capturing said cover portion between said housing and said flange.

29. Dispenser apparatus as defined in claim 28 wherein said flange includes a drive lug engageable with a drive notch in said cover portion whereby said support and cover portions may be concomitantly rotated in a first direction.

30. Dispenser apparatus for a dishwasher having a front opening providing an access to a washing chamber, an access door with inner and outer panels for opening and closing the access, comprising: detergent dispensing means having a housing on said inner panel including a plurality of detergent holding cavities; additive dispensing means on said inner pane integrated with said detergent dispensing means and including a container and closure means for sealing said container; rotatable cover means including a support portion having a shaft rotatably journaled in said housing and a flange, said cover means further including a cover portion disposed between said housing and said flange for covering and effectively sealing at least one of said detergent holding cavities and drivingly coupled to said flange for rotation therewith; and control means for sequentially actuating movement of said cover means in a first direction of rotation to effect detergent dispensing and for actuating movement of said closure means responsive to movement of said cover means to effect additive dispensing, said cover portion of said cover means selectively manually disengageable from said support portion flange for rotation independent of rotation of said support portion shaft.

31. Dispenser apparatus for a dishwasher having a front opening providing an access to a washing chamber, an access door with inner and outer panels for opening and closing the access, comprising: detergent dispensing means having a housing on said inner panel including a plurality of detergent holding cavities; additive dispensing means on said inner panel integrated with said detergent dispensing means and including a container and closure means for sealing said container; rotatable cover means in a support portion having a shaft rotatably journaled in said housing and an annular flange incorporating a drive lug, said cover means further including a cover portion captured between said housing and said annular flange for covering and effectively sealing at least one of said detergent holding cavities, said cover portion having a drive notch drivingly coupled to said drive lug; and control means for sequentially actuating movement of said cover means in a first direction to effect detergent dispensing and for actuating movement of said closure means responsive to movement of said cover means to effect additive dispensing, said cover means movable form a first stop and sequentially through a plurality of stops to uncover said detergent holding cavities and operate said additive dispensing means, said cover portion of said cover means being rotatable in said first direction with rotation of said support portion and selectively manually disengageable from said support portion for rotation independent of rotation of said support portion.

32. Dispenser apparatus for a dishwasher having a front opening providing an access to a washing chamber, an access door with inner and outer panels and operable for opening and closing the access, comprising: detergent dispensing means on said inner panel including at least one cavity and cover means, said detergent dispensing means further including labyrinth seal means cooperable with said inner panel and said cover means for effectively sealing said cavity; additive dispensing means on said inner panel integrated with said detergent dispensing means and including a container and closure means for sealing said container; and control means for sequentially actuating movement of said cover means to effect detergent dispensing and for actuating movement of said closure means responsive to movement of said cover means to effect additive dispensing.

33. Dispenser apparatus as defined in claim 32 wherein said inner panel is molded of plastic and said cavity and container are formed as a unit.

34. Dispenser apparatus for a dishwasher having a front opening providing an access to a washing chamber, an access door with inner and outer door panels and operable for selectively opening and closing the access, comprising: detergent dispensing means having a housing on said inner panel including at least one detergent holding cavity and cover means and further including labyrinth seal means on said inner panel and said cover means for effectively sealing said cavity; additive dispensing means integrated with said detergent dispensing means and including a container and closure means for sealing said container; and control means for sequentially actuating movement of said cover means to effect detergent dispensing and for actuating movement of said closure means responsive to movement of said cover means to effect additive dispensing, said labyrinth seal means including first channel means integral with said housing adjacent at least one edge of said cavity and second channel means integral with said cover means cooperatively juxtaposed to said first channel means.

35. Dispenser apparatus as defined in claim 34 wherein said first channel means includes a pair of spaced-apart wall members and said second channel means includes a spaced-apart lip portion and a ledge portion.

36. Dispenser apparatus as defined in claim 35 wherein said lip portion of said second channel means is in substantial line-to-line contact with said housing and said wall members are in substantial line-to-line contact with said cover means.

37. Dispenser apparatus as defined in claim 35 wherein said ledge portion extends into the space between said wall members of said first channel means and includes an upturned edge for guiding washing liquid away from said cavity.

38. Dispenser apparatus for a dishwasher having a front opening providing an access to a washing chamber, an access door with inner and outer door panels and operable from selectively opening and closing the access, comprising: detergent dispensing means on said inner panel including at least one detergent holding cavity and cover means and further including labyrinth seal means for effectively sealing said cavity; additive dispensing means integrated with said detergent dispensing means and including a cotnainer and closure means for sealing said container; and control means for sequentially actuating movement of said cover means to effect detergent dispensing and for actuating movement of said closure means responsive to movement of said cover means to effect additive dispensing, said labyrinth seal means including a channel integral with said detergent dispensing means adjacent at least one edge of said cavity and having a pair of spaced-apart wall members extending into said washing chamber, said labyrinth seal means further including a lip portion on said cover means generally parallel to said channel wall members, said channel wall members further being in substantial line contact with said cover means.

39. Dispenser apparatus as defined in claim 38 wherein said cover means further includes a ledge portion radially inwardly spaced from and generally parallel to said lip portion and extending between said wall members, said ledge portion having an upturned edge for guiding washing liquid away from said cavity.

* * * * *